US012296926B2

(12) United States Patent
Scott

(10) Patent No.: US 12,296,926 B2
(45) Date of Patent: May 13, 2025

(54) KAYAK ANCHOR SUPPORT SYSTEM

(71) Applicant: William Scott, Edmonds, WA (US)

(72) Inventor: William Scott, Edmonds, WA (US)

( * ) Notice: Subject to any disclaimer, the term of this patent is extended or adjusted under 35 U.S.C. 154(b) by 343 days.

(21) Appl. No.: 17/876,022

(22) Filed: Jul. 28, 2022

(65) Prior Publication Data

US 2023/0061719 A1 Mar. 2, 2023

Related U.S. Application Data

(60) Provisional application No. 63/236,351, filed on Aug. 24, 2021, provisional application No. 63/236,396, filed on Aug. 24, 2021.

(51) Int. Cl.
*B63B 21/04* (2006.01)
*B63B 21/22* (2006.01)
*B63B 34/26* (2020.01)

(52) U.S. Cl.
CPC ..... *B63B 21/04* (2013.01); *B63B 21/22* (2013.01); *B63B 34/26* (2020.02)

(58) Field of Classification Search
CPC ..... B63B 21/22; B63B 21/04
See application file for complete search history.

(56) References Cited

U.S. PATENT DOCUMENTS 1,800,851 A * 4/1931 Wennerstrom ..... B63B 21/22 254/326
2,699,918 A * 1/1955 Bush ..... A01K 89/015 242/399
3,140,003 A * 7/1964 Horner ..... B60P 3/1058 414/483
5,025,746 A 6/1991 Boulter
8,082,869 B2 12/2011 Beaty
9,016,225 B1 4/2015 Jenkins
2007/0181051 A1 8/2007 Waldrop
2014/0352596 A1 12/2014 VanScoyoc

FOREIGN PATENT DOCUMENTS

FR 2682474 A1 * 4/1993 ..... B63B 21/22
WO WO-2012106704 A1 * 8/2012 ..... B63B 21/22

* cited by examiner

*Primary Examiner* — S. Joseph Morano
*Assistant Examiner* — Jovon E Hayes
(74) *Attorney, Agent, or Firm* — Boudwin Intellectual Property Law, LLC; Daniel Boudwin

(57) ABSTRACT

A kayak anchor support system includes a first support arm having a first end opposite a second end, wherein the first support arm is removably securable to a kayak via at least one mounting bracket. A proximal end of a second support arm is affixed to the first support arm adjacent to the first end. The second support arm extends orthogonally from the first support arm such that a distal end of the second support arm is maintained in an elevated position above the kayak. A pulley is affixed to the distal end of the second support arm. An anchor cable is engaged with each of the pulley and a reel, wherein the reel is disposed opposite the pulley. An anchor is affixed to a terminal end of the anchor cable, whereupon actuation of the reel, the anchor is selectively movable between a raised position and a lowered positioned.

16 Claims, 6 Drawing Sheets

KAYAK ANCHOR SUPPORT SYSTEM

CROSS REFERENCE TO RELATED APPLICATIONS

This application claims the benefit of U.S. Provisional Application No. 63/236,351 filed on Aug. 24, 2021, and U.S. Provisional Application No. 63/236,396 filed on Aug. 24, 2021. The above identified patent applications are herein incorporated by reference in their entirety to provide continuity of disclosure.

BACKGROUND OF THE INVENTION

The present invention relates to anchor support systems. More particularly, the present invention pertains to an anchor support system removably securable to a kayak.

Many individuals enjoy kayaking as a hobby, or in conjunction with another hobby, such as fishing. Often, an individual may wish to remain stationary in a kayak to relax in the center of a body of water, or to remain in the same place while fishing. Typically, an anchor may be used to retain the kayak in a desired location, however, when not in use, the anchor must often be coiled and stored within the passenger compartment of the kayak. However, there is generally minimal storage space within a kayak to keep an anchor when not in use, and as such, the anchor can become a burden that interferes with the user's comfort or enjoyment of the kayak. Additionally, as typical anchor systems utilize a free rope, the rope may become tangled in other items and equipment stored within the kayak. Furthermore, when maneuvering about the kayak to retrieve the anchor or disentangle the rope from another piece of equipment, the kayak may become unstable and capsize. Finally, a single anchor system may be insufficient to retain the kayak in a stable position, as currents may cause the kayak to rotate about the anchor point. Therefore, a system that can easily store and deploy one or more anchors from a kayak without interfering with the passenger compartment or other operation of the kayak is desired.

In light of the devices disclosed in the known art, it is submitted that the present invention substantially diverges in design elements from the known art and consequently it is clear that there is a need in the art for an improvement to existing anchor support systems. In this regard, the instant invention substantially fulfills these needs.

SUMMARY OF THE INVENTION

In view of the foregoing disadvantages inherent in the known types of anchor support systems now present in the known art, the present invention provides an anchor support system removably securable to a kayak wherein the same can be utilized for providing convenience for the user when retaining the kayak in a desired position in a body of water.

The present system comprises a front kayak anchor support having a first support arm having a first end opposite a second end. The first support arm is removably securable to a kayak via at least one mounting bracket. A proximal end of a second support arm is affixed to the first support arm adjacent to the first end. The second support arm extends orthogonally from the first arm such that a distal end of the second support arm is maintained in an elevated position above the kayak. A pulley is affixed to the distal end of the second support arm. An anchor cable is engaged with each of the pulley and a reel, wherein the reel is disposed opposite the pulley. An anchor is affixed to a terminal end of the anchor cable, whereupon actuation of the reel, the anchor is selectively movable between a raised position and a lowered position. In some embodiments, a brace is affixed to each of the first and second support arms, wherein the brace extends between the second end of the first support arm and a central portion of the second support arm. In another embodiment, each of the first support arm and the second support arm comprise tubular structures. In other embodiments, an upper portion of the second support arm is angled outwardly towards the first end of the first support arm such that the distal end is disposed in a coplanar relationship with the first end. In yet another embodiment, a pair of guide openings extend through the first support arm between the first end and the second support arm, wherein the pair of guide openings receive the anchor cable therethrough. In some embodiments, a pair of cutouts are disposed through a lower side of the first support arm, wherein the pair of cutouts operably engage a pair of retention bars affixed to the kayak. In other embodiments, a routing conduit is affixed to a lateral side of the kayak and extending between the reel and the first support arm, wherein the anchor cable extends through the routing conduit such that the routing conduit restrains the anchor cable therein.

Alternatively, a rear kayak anchor support comprises a support member having a first end opposite a second end, wherein the support member is removably securable to a kayak via at least one mounting bracket. A proximal end of an upper member is affixed to the support member adjacent to the first end, wherein the upper member extends rearwardly from the support member at an angle such that a distal end of the upper member is maintained in an elevated position above the kayak. The upper member extends perpendicularly relative to a longitudinal axis of the support member. A pulley is affixed to the distal end of the upper member. An anchor cable is engaged with each of the pulley and a reel, wherein the reel is disposed opposite the pulley. An anchor is affixed to the terminal end of the anchor cable, whereupon actuation of the reel, the anchor is selectively movable between a raised position and a lowered position. In some embodiments, a brace is affixed to an upper surface of the kayak and the distal end of the upper member. In other embodiments, each of the support member and the upper member comprise tubular structures. In another embodiment, a routing conduit is affixed to a lateral side of the kayak and extends between the reel and the support member, wherein the anchor cable extends through the routing conduit such that the routing conduit restrains the anchor cable therein. In yet another embodiment, an extension conduit is in communication with the routing conduit, wherein the extension conduit curves such that a terminal end of the extension conduit is substantially parallel to the support member. In some embodiments, a terminal end of the extension conduit is disposed at a height between the support member and the distal end of the upper member, such that the extension conduit terminates proximal to the pulley.

In some embodiments, each of the above structures can be used in tandem on a single kayak to define a front kayak anchor support system and a rear kayak anchor support system. Utilizing the combination of the front and rear kayak anchor support systems provides a pair of anchors that can be deployed simultaneously from each opposing end of the kayak. In this manner, rotation of the kayak about a single anchor point is avoided, ensuring a stable and stationary kayak platform.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
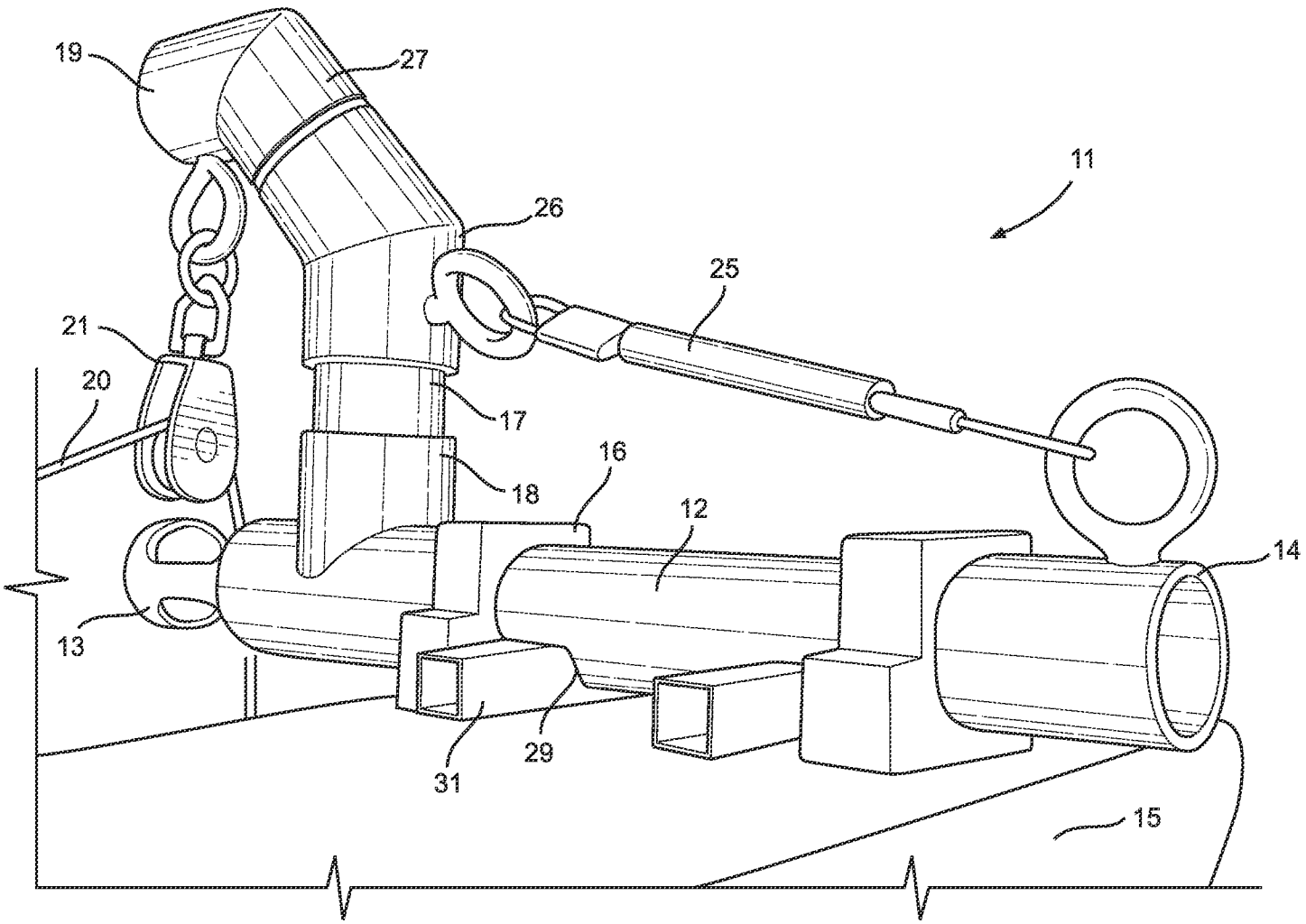
FIG. 1A shows a perspective view of an embodiment of the front kayak anchor support system.

Reference is made herein to the attached drawings. Like reference numerals are used throughout the drawings to depict like or similar elements of the kayak anchor support system. The figures are intended for representative purposes only and should not be considered to be limiting in any respect.

Figure 1B:
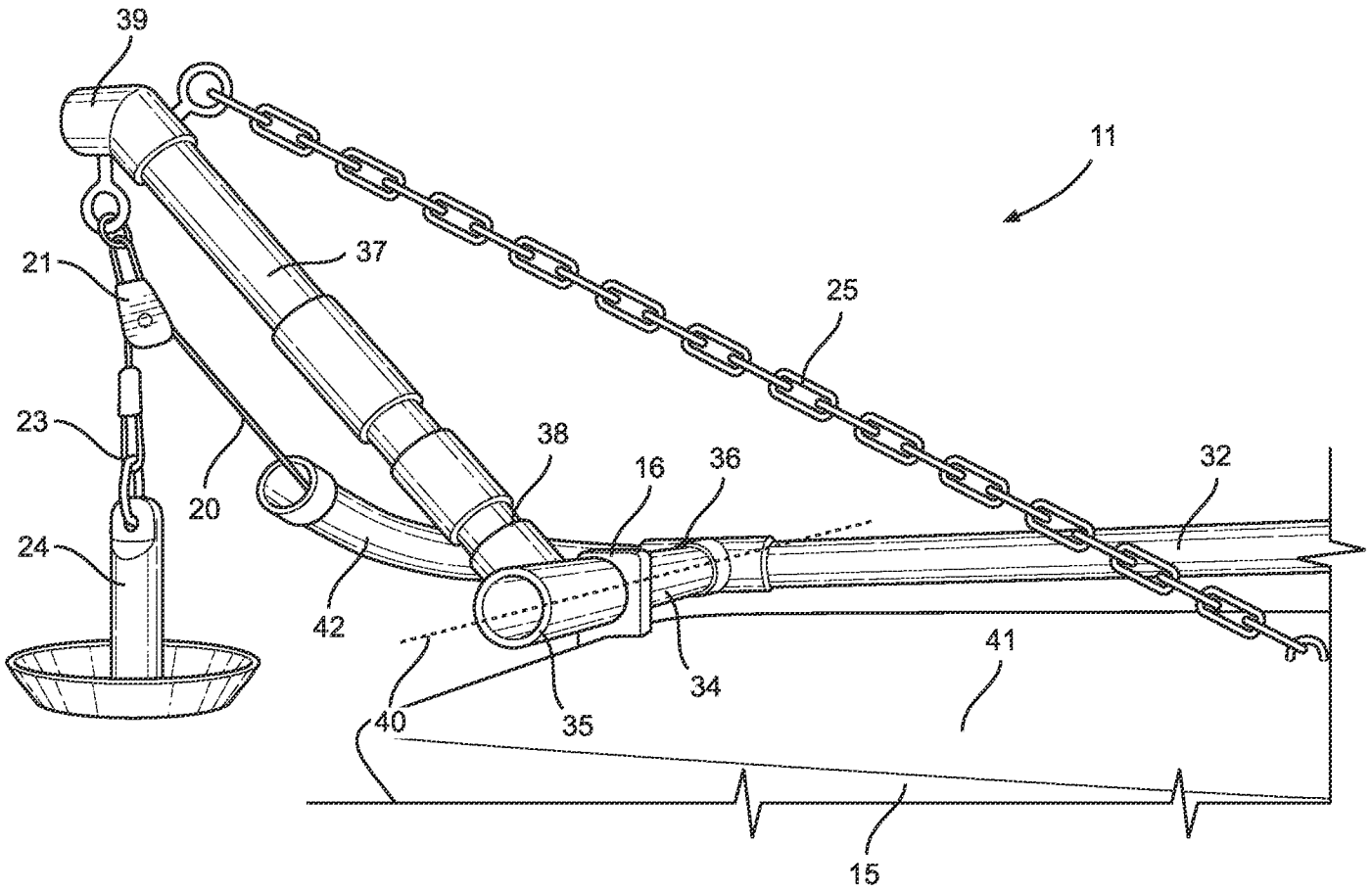
FIG. 1B shows a perspective view of an embodiment of the rear kayak anchor support system.

Referring now to FIG. 1A, there is shown a perspective view of an embodiment of the front kayak anchor support system. In the illustrated embodiment, the kayak anchor support system 11 comprises a first support arm 12 having a first end 13 opposite a second end 14. In such embodiments, the kayak support system 11 is contemplated to be placed on a front end of an existing kayak 15, such that an anchor (as shown in FIG. 1B, 24) can be suspended off of the front end of the kayak 15. A proximal end 18 of a second support arm 17 is affixed to the first support arm 12 adjacent to the first end 13, wherein the second support arm 17 extends orthogonally from the first support arm 12 to maintain a distal end 19 of the second support arm 17 in an elevated position above the kayak 15. In the shown embodiment, an upper portion 27 of the second support arm 17 is angled outwardly towards the first end 13 along a longitudinal axis of the first support arm 12, such that the anchor suspended from a distal end 19 of the second support arm 17 is disposed over a lateral side of the kayak 15 at the front end thereof. Particularly, in the illustrated embodiment, the upper portion 27 is disposed at a 45-degree angle relative to a lower portion of the second support arm 17. In this manner, the second support arm 17 is offset from a centerline of the kayak 15 to increase visibility while the kayak 15 is in use. In the illustrated embodiment, the first and second support arms 12, 17 are contemplated to comprise a tubular structure having a hollow interior channel, to provide convenience of manufacture from existing piping systems, as well as to reduce weight of the kayak anchor support system 11. In the illustrated embodiment, each of the first and second support arms 12, 17 comprise circular tubing, however, alternate tubular structures, such as rectangular tubing are also contemplated. In the shown embodiment, the kayak anchor support system 11 comprises a modular construction comprising an assembly of existing piping segments, such that a user can disassemble each kayak anchor support system 11 for storage or transport. However, in alternate embodiments, such as that illustrated in at least FIG. 2B, the kayak anchor support system 11 is contemplated to comprise a singular unitary construction. In this manner, the kayak anchor support system 11 can be efficiently installed onto an existing kayak 15 with minimal effort expended for assembly thereof.

The first support arm 12 is removably affixed to a kayak 15 via one or more mounting brackets 16. The mounting brackets 16 are contemplated to be directly secured to the upper surface of the kayak 15, or alternatively, connected to a handrail or existing bracket system disposed on the kayak 15. In the shown embodiment, the mounting brackets 16 comprise circular clamps removably securable to the kayak 15, wherein the circular clamps selectively constrict about a circumference of the first support arm 12 to frictionally secure the first support arm 12 therein. Alternatively, the first support arm 12 may be removably secured to the kayak 15 via alternate fastening means, such as mechanical connections including bolts, screws, or the like. In the illustrated embodiment, a pair of cutouts 29 are disposed through a lower side of the first support arm 12, wherein the pair of cutouts 29 are each dimensioned to receive one of a pair of retention bars 31 affixed to the kayak 15 therein. In this manner, the engagement of the pair of retention bars 31 within the pair of cutouts 29 prevents the first support arm 12 from rotating or laterally shifting along the kayak 15 during use.

Figure 3:
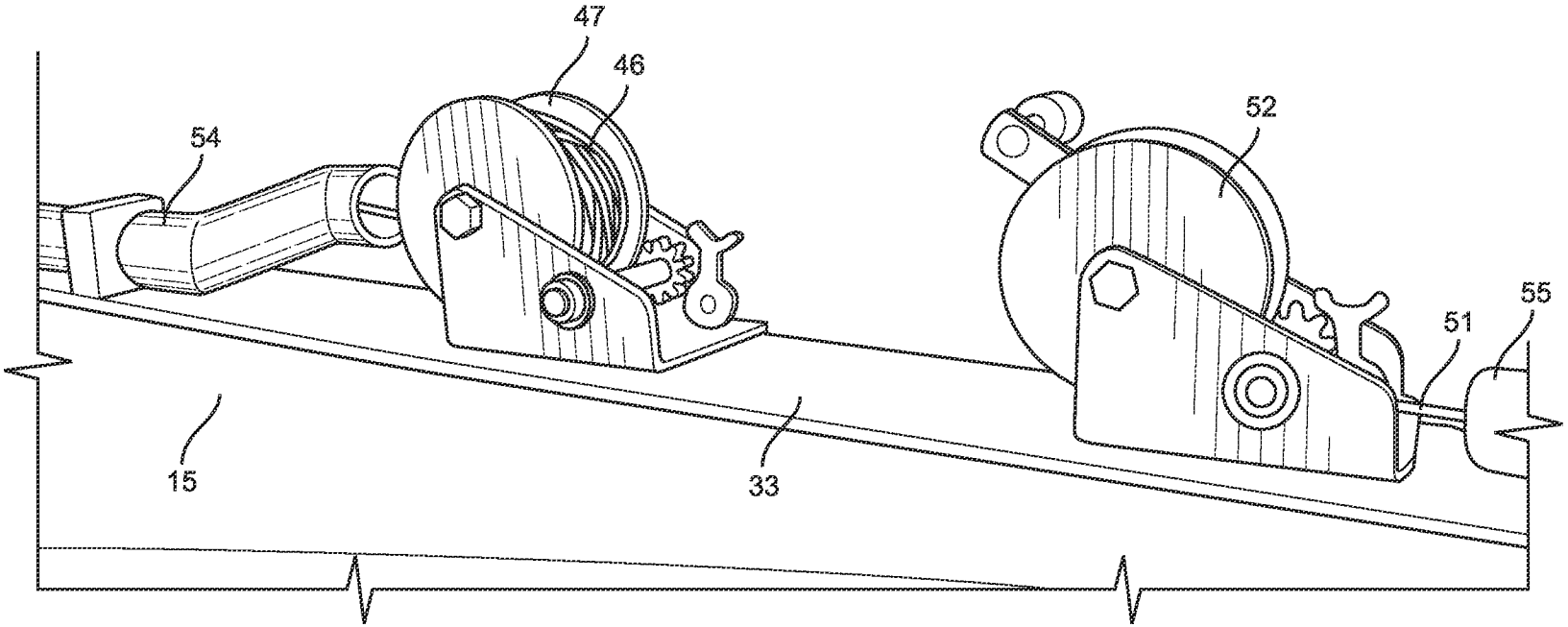
FIG. 3 shows a perspective view of the reels and routing conduits of an embodiment of the kayak anchor support system.

In the shown embodiment, a pulley 21 is suspended from the distal end 19 of the second support arm 17, wherein the pulley 21 is configured to engage an anchor cable 20. The anchor is affixed at a terminal end (as shown in FIG. 1B, 23) of the anchor cable 20, wherein the pulley 21 facilitates raising and lowering the anchor as an associated front reel (as shown in FIG. 3, 47) disposed opposite the pulley 21 is actuated. In the illustrated embodiment, an eyebolt is affixed to the distal end 19, wherein the pulley 21 is secured thereto, such that the pulley 21 is pivotally affixed to the second support arm 17. Furthermore, in the shown embodiment, a brace 25 extends between a central portion 26 of the second support arm 17 and the second end 14 of the first support arm 12, wherein the brace 25 is configured to increase structural integrity of the second support arm 17 to support the anchor thereon. Similarly, in the shown embodiment, the brace 25 is affixed at opposing ends thereof to eyebolts affixed to each of the central portion 26 and the second end 14.

Referring now to FIG. 1B, there is shown a perspective view of an embodiment of the rear kayak anchor support system. In the shown embodiment, the kayak anchor support system 11 is contemplated for securement to a rear end of the kayak 15 to provide an anchor 24 disposed on the rear end of the kayak 15. In such embodiments, the kayak anchor support system 11 comprises a support member 34 having a first end 35 opposite a second end 36, wherein the support member 34 is removably securable to the kayak 15 via one or more mounting brackets 16 as previously discussed in reference to the embodiment shown in FIG. 1A. Similarly, the support member 34 is contemplated to be removably securable to the kayak 15 via alternate fastening means as previously discussed. A proximal end 38 of an upper member 37 is affixed to the support member 34 adjacent to the first end 35 of the support member 34. The upper member 37 extends rearwardly from the support member 34, such that a distal end 39 of the upper member 37 is disposed perpendicular to a longitudinal axis 40 of the support member 34 in an elevated position above the kayak 15. As such, the elevation ensures that the anchor 24 is disposed above a body of water when the anchor 24 is in the raised position. Furthermore, the orientation of the upper member 37 extends off of the rear end of the kayak 15. In the shown embodiment, the upper member 37 is disposed at a 45-degree angle relative to the support member. In the illustrated embodiment, the support member 34 and the upper member 37 are contemplated to comprise a tubular structure having a hollow interior channel, to provide convenience of manufacture from existing piping systems, as well as to reduce weight of the kayak anchor support system 11.

A pulley 21 is affixed to a lower side of the distal end 39 of the upper member 37, wherein the pulley 21 is configured to engage an anchor cable 20 having an anchor 24 affixed to a terminal end 23 thereof. The anchor 24 is configured to selectively move between a raised position and a lowered position upon actuation of an associated rear reel (as shown in FIG. 3, 52) disposed opposite the pulley 21. In the illustrated embodiment, the distal end 39 is disposed at a 45-degree angle relative to the upper member 37, such that a plane of the distal end 39 is disposed perpendicular to a plane of the first end 35 of the support member 34. In the shown embodiment, a brace 25 is affixed to a distal end 39 of the upper member 37 at one end and to an upper surface 41 of the kayak 15 at an opposing end, such that the distal end 39 of the upper member 37 is maintained in an upright position to counteract the weight of the anchor 24 attached to the distal end 39 by the pulley 21 affixed thereto. Furthermore, in the shown embodiment, the anchor cable 20 is guided towards the pulley 21 from the reel via a routing conduit 32 disposed on a lateral side of the kayak 15. The routing conduit 32 further comprises an extension conduit 42 affixed directly to an end of the routing conduit 32 opposite the reel, wherein the extension conduit 42 is curved to reorient the anchor cable 20 in a direction perpendicular to a longitudinal axis of the routing conduit 32, such that the anchor cable 20 is disposed substantially parallel to the longitudinal axis 40 of the support member 34 as it exits the extension conduit 42. In this manner, the anchor cable 20 is directed to the pulley 21 in a guarded manner to prevent tangling or fouling with any other lines or objects in use with the kayak 15.

Figure 2A:
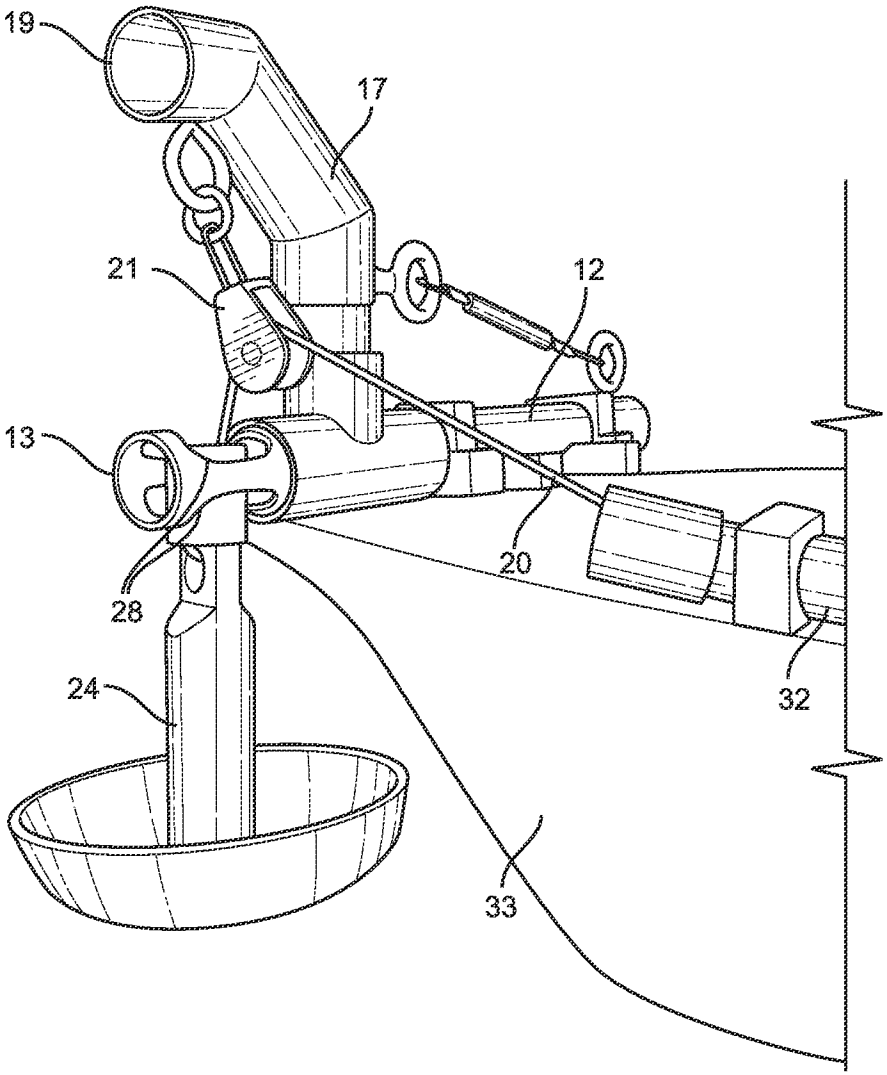
FIG. 2A shows a perspective view of the pulley of an embodiment of the front kayak anchor support system.

Referring now to FIG. 2A, there is shown a perspective view of the pulley of an embodiment of the front kayak anchor support system. The pulley 21 is disposed over a lateral side 33 of the front end of the kayak, such that the anchor 24 is aligned off to one side of the kayak to preserve the user's visibility. In the shown embodiment, the distal end 19 of the second support arm 17 is further angled from the upper portion of the second support arm 17, such that the distal end 19 is disposed in a coplanar relationship with the first end 13 of the first support arm 12. In some such embodiments, the distal end 19 is angled at 45-degrees relative to the upper portion of the second support arm 17. In this manner, the pulley 21 is aligned with a pair of guide openings 28 disposed through the first end 13 of the first support arm 12, wherein the pair of guide openings 28 are configured to constrain the anchor cable 20 therein. As such, the pair of guide openings 28 ensure that the anchor 24 is maintained in a desired position during use. In this illustrated embodiment, the pair of guide openings 28 are vertically aligned through the first end 13 of the first support arm 12, such that a perimeter of each guide opening of the pair of guide openings 28 are identical and disposed directly opposite each other. In the shown embodiment, a routing conduit 32 is disposed along a lateral side 33 of the kayak, wherein the routing conduit 32 provides a channel through which the anchor cable 20 is threaded and guided towards the pulley 21. The routing conduit 32 prevents the anchor cable 20 from tangling or becoming fouled in other lines during use.

Figure 2B:
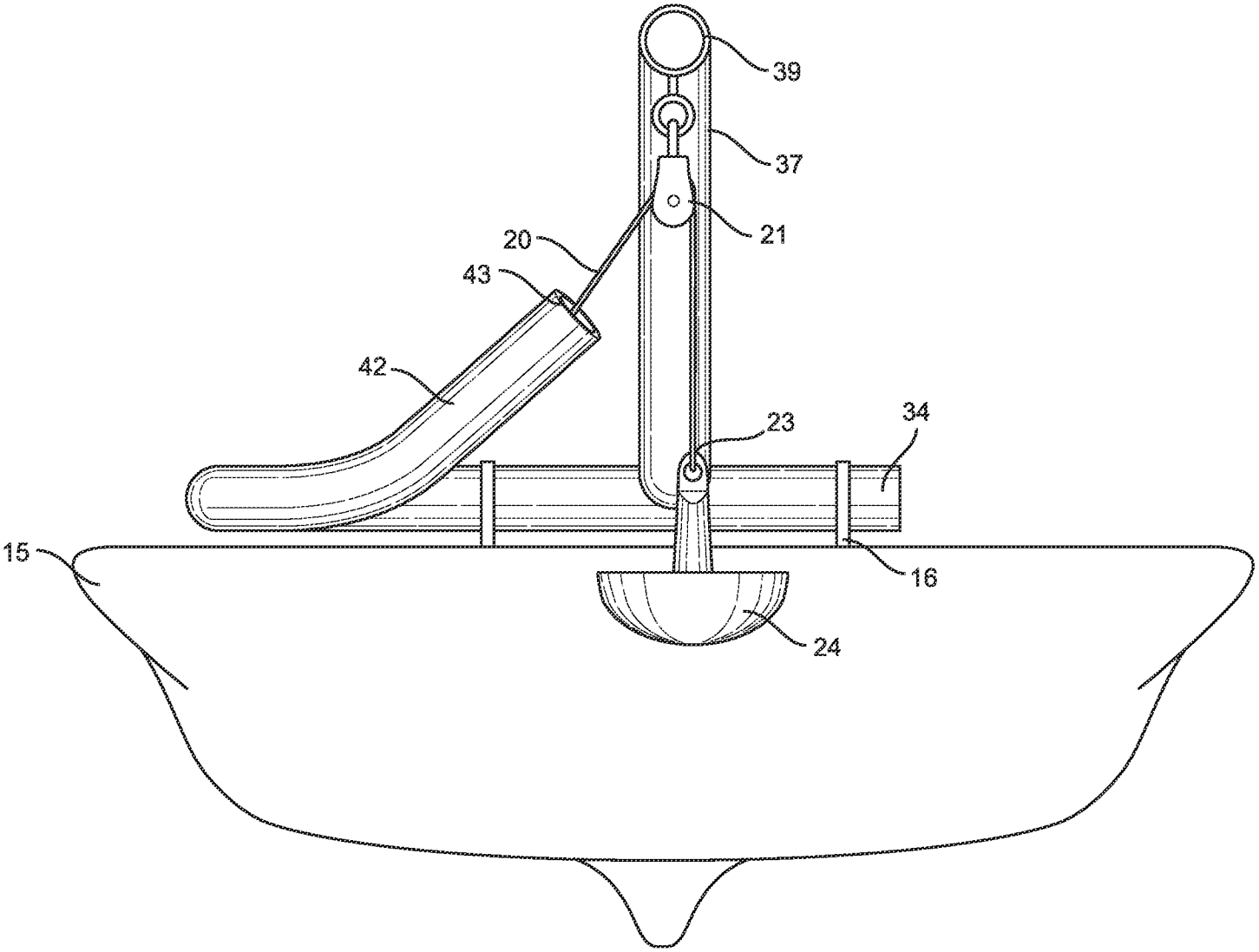
FIG. 2B shows a front view of an embodiment of the rear kayak anchor support system.

Referring now to FIG. 2B, there is shown a front view of an embodiment of the rear kayak anchor support system. In the illustrated embodiment, the support member 34, upper member 37, routing conduit, and the extension conduit 42 all comprise a unitary structure having a consistent exterior diameter. In this manner, the kayak anchor support system need not be assembled from constituent parts before use and can be installed on a kayak 15 with minimal effort with one or more mounting brackets 16. Similarly, the unitary construction facilitates customization at the manufacturing level, such that the kayak anchor support system can be designed for use with existing kayaks of various makes, models, and styles. In the shown embodiment, the pulley 21 is suspended from the distal end 39 of the upper member 37 via an eyebolt, wherein the anchor 24 is in turn suspended from the pulley 21 via the terminal end 23 of the anchor cable 20. The anchor cable 20 is guided towards the pulley 21 via the extension conduit 42. In the shown embodiment, the extension conduit 42 further curves upwardly towards the distal end 39 of the upper member 37, such that a terminal end 43 of the extension conduit 42 is disposed at a height between that of the support member 34 and the distal end 39. In this manner, the extension conduit 42 terminates proximal to the pulley 21 to minimize the length of exposed anchor cable 20 to reduce the risk of damage, tangling, or fouling with other lines or objects on the kayak 15.

Figure 4:
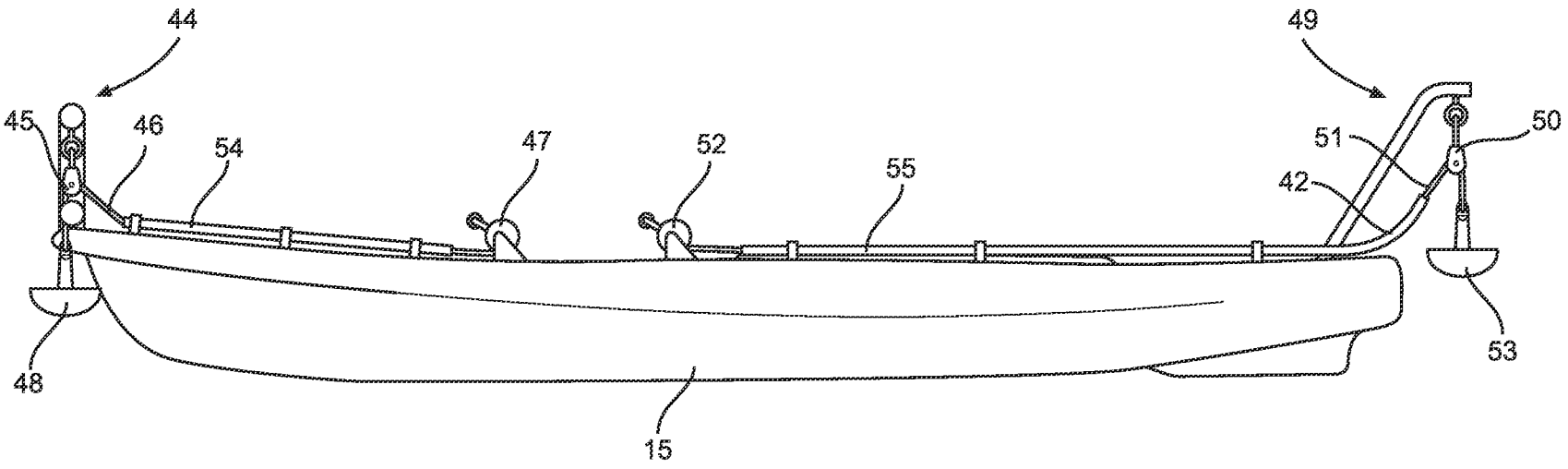
FIG. 4 shows a side view of an embodiment of the kayak anchor support system in use.

Referring now to FIG. 3, there is shown a perspective view of the reels and routing conduits of an embodiment of the kayak anchor support system. In the illustrated embodiment, a pair of reels are disposed on the lateral side 33 of the kayak, wherein each reel is associated with one of the embodiments of FIGS. 1A and 1B. It should be understood that each of the kayak anchor support systems shown and described in FIGS. 1A and 1B can be used independently to provide a single anchor at a preferred end of the kayak, however, in the shown embodiment, the pair of reels are shown together to provide brevity of disclosure. A front reel 47 is affixed to the lateral side 33 and is engaged with a first anchor cable 46, wherein the first anchor cable 46 is affixed to a front anchor (as shown in FIG. 4, 48). The first anchor cable 46 extends between the front reel 47 and the front anchor via a first routing conduit 54 affixed along a length of the lateral side 33 of the kayak. In the shown embodiment, the first routing conduit 54 is affixed to the kayak by one or more mounting brackets such as circular clamps as previously described elsewhere herein. In the illustrated embodiment, a portion of the first routing conduit 54 includes an offset portion configured to redirect the first anchor cable 46 to a course running along the lateral side 33 of the kayak 15. Similarly, a rear reel 52 is affixed to the lateral side 33 opposite the front reel 47, wherein the rear reel 52 is engaged with a second anchor cable 51 affixed to a rear anchor (as shown in FIG. 4, 53). The second anchor cable 51 extends between the rear reel 52 and the rear anchor via a second routing conduit 55 affixed along a length of the lateral side 33 of the kayak. In such embodiments, the front and rear reels 47, 52 are disposed adjacent to each other to provide convenience to the user to selectively raise or lower both of the front and rear anchors.

Referring now to FIG. 4, there is shown a side view of an embodiment of the kayak anchor support system in use. In the shown embodiment, a front kayak anchor support system 44 is disposed on a front end of the kayak 15, and a rear kayak anchor support system 49 is disposed on a rear end of the kayak 15. The front kayak anchor support system 44 is contemplated to comprise the embodiment as previously described in reference to FIGS. 1A and 2A, whereas the rear kayak anchor support system 49 is contemplated to comprise the embodiment as previously described in reference to FIGS. 1B and 2B. In this manner, the user can simultaneously deploy a front anchor 48 and a rear anchor 53 to stabilize the kayak 15 from opposing ends, such that the kayak 15 is prevented from rotating due to currents, wind, or other interaction. The user can removably secure the front and rear kayak anchor support systems 44, 49 to each of the front and rear ends of the kayak 15 and thread the first anchor cable 46 through the first routing conduit and into a first pulley 45, such that upon actuation of the front reel 47, the front anchor 48 selectively moves between a raised position and a lowered position. As the front kayak anchor support system 44 is offset to deploy the front anchor 48 off a lateral side of the kayak 15, the user's visibility off of the front end of the kayak 15 is maintained. Similarly, the second anchor cable 51 can be threaded through the second routing conduit 55 to engage a second pulley 50, such that upon actuation of the rear reel 52, the rear anchor 53 can be selectively moved between a raised position and a lowered position. In this manner, the user can stabilize a kayak 15 by deploying an anchor on opposing ends thereof, such that the kayak 15 is prevented from rotating while each anchor 48, 53 is in the lowered position.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kayak anchor support, comprising:

a first support arm having a first end opposite a second end;

comprising a pair of cutouts disposed through a lower side of the first support arm, wherein the pair of cutouts operably engage a pair of retention bars affixed to the kayak;

wherein the first support arm is removably securable to a kayak via at least one mounting bracket;

a second support arm, wherein a proximal end of the second support arm is affixed to the first support arm adjacent to the first end;

wherein the second support arm extends orthogonally from the first support arm such that a distal end of the second support arm is maintained in an elevated position above the kayak;

an upper member, wherein a proximal end of the upper member is affixed to the support member adjacent to the first end;

a pulley affixed to the distal end of the upper member;

wherein an upper portion of the second support arm is angled outwardly towards the first end of the first support arm such that the distal end is disposed in a coplanar relationship with the first end;

further comprising a brace affixed to each of the first and second support arms, wherein the brace extends between the second end of the first support arm and a central portion of the second support arm;

a pulley affixed to the distal end of the second support arm;

an anchor cable engaged with each of the pulley and a reel, wherein the reel is disposed opposite the pulley;

an anchor is affixed to a terminal end of the anchor cable;

whereupon actuation of the reel, the anchor is selectively movable between a raised position and a lowered position.

2. The kayak anchor support of claim 1, wherein each of the first support arm and the second support arm comprise tubular structures.

3. The kayak anchor support of claim 1, further comprising a pair of guide openings extending through the first support arm between the first end and the second support arm, wherein the pair of guide openings receive the anchor cable therethrough.

4. The kayak anchor support of claim 1, further comprising a routing conduit affixed to a lateral side of the kayak and extending between the reel and the first support arm, wherein the anchor cable extends through the routing conduit such that the routing conduit restrains the anchor cable therein.

5. The kayak anchor support of claim 1, further comprising a brace affixed to an upper surface of the kayak and the distal end of the upper member.

6. The kayak anchor support of claim 1, wherein each of the support member and the upper member comprise tubular structures.

7. The kayak anchor support of claim 1, further comprising a routing conduit affixed to a lateral side of the kayak and extending between the reel and the support member, wherein the anchor cable extends through the routing conduit such that the routing conduit restrains the anchor cable therein.

8. The kayak anchor support of claim 7, further comprising an extension conduit in communication with the routing conduit, wherein the extension conduit curves such that a terminal end of the extension conduit is substantially parallel to the support member.

9. The kayak anchor support of claim 8, wherein a terminal end of the extension conduit is disposed at a height between the support member and the distal end of the upper member, such that the extension conduit terminates proximal to the pulley.

10. A kayak anchor support system, comprising:

a front kayak anchor support system and a rear kayak anchor support system;

wherein the front kayak anchor support system comprises:

a first support arm having a first end opposite a second end;

wherein the first support arm is removably securable to a front end of a kayak via at least one mounting bracket;

a second support arm, wherein a proximal end of the second support arm is affixed to the first support arm adjacent to the first end;

wherein the second support arm extends orthogonally from the first arm such that a distal end of the second support arm is maintained in an elevated position above the kayak;

a first pulley affixed to the distal end of the second support arm;

a first anchor cable engaged with each of the first pulley and a front reel, wherein the front reel is disposed opposite the first pulley;

a front anchor is affixed to a terminal end of the first anchor cable;

whereupon actuation of the front reel, the front anchor is selectively movable between a raised position and a lowered position;

wherein the rear kayak anchor support system comprises:

a support member having a first end opposite a second end;

wherein the support member is removably securable to a rear end of the kayak via at least one mounting bracket;

an angled upper member, wherein a proximal end of the upper member is affixed to the support member adjacent to the first end of the support member;

wherein the upper member extends rearwardly from the support member at an angle such that a distal end of the upper member is maintained in an elevated position above the kayak;

wherein the upper member extends perpendicular to a longitudinal axis of the support member;

a second pulley affixed to the distal end of the upper member;

a second anchor cable engaged with each of the second pulley and a rear reel, wherein the rear reel is disposed opposite the second pulley;

a rear anchor is affixed to a terminal end of the second anchor cable;

whereupon actuation of the rear reel, the rear anchor is selectively movable between a raised position and a lowered position.

11. The kayak anchor support of claim 10, further comprising a first routing conduit and a second routing conduit affixed to a lateral side of the kayak and extending between the front reel and the first support arm and the rear reel and the support member, respectively, wherein the first anchor cable extends through the first routing conduit and the second anchor cable extends through the second routing conduit.

12. The kayak anchor support of claim 11, further comprising an extension conduit in communication with the second routing conduit, wherein the extension conduit curves such that a terminal end of the extension conduit is substantially parallel to the support member.

13. The kayak anchor support of claim 12, wherein a terminal end of the extension conduit is disposed at a height between the support member and the distal end of the upper member, such that the extension conduit terminates proximal to the second pulley.

14. The kayak anchor support of claim 10, wherein each of the first support arm, the second support arm, the support member, and the upper member comprise tubular structures.

15. The kayak anchor support of claim 10, wherein an upper portion of the second support arm is angled outwardly towards the first end of the first support arm such that the distal end of the second support arm is disposed in a coplanar relationship with the first end of the first support arm.

16. The kayak anchor support of claim 10, further comprising a pair of guide openings extending through the first support arm between the first end and the second support arm, wherein the pair of guide openings receive the first anchor cable therethrough.

* * * * *